US005639035A

United States Patent [19]

Maugle et al.

[11] Patent Number: 5,639,035

[45] Date of Patent: Jun. 17, 1997

[54] SLUDGE TREATMENT UNIT

[76] Inventors: Thad S. Maugle, 109 McDonald Dr., Duncansville, Pa. 16635; David A. Rhoa, R.D. #5, Box 235, Altoona, Pa. 16601

[21] Appl. No.: 221,398

[22] Filed: Mar. 31, 1994

[51] Int. Cl.[6] ..... B02C 18/06; B02C 18/18

[52] U.S. Cl. ..... 241/236; 241/243; 241/294

[58] Field of Search ..... 241/236, 243, 241/247, 261, 294

[56] References Cited

U.S. PATENT DOCUMENTS

| | | | |
|---|---|---|---|
| 2,903,192 | 9/1959 | Clausen | 241/261 |
| 3,931,936 | 1/1976 | Petry et al. | 241/46.15 |
| 4,013,234 | 3/1977 | Fay | 241/101.6 |
| 4,079,003 | 3/1978 | Manchak | 210/46 |
| 4,284,247 | 8/1981 | Eriksson | 241/260.1 |
| 4,457,058 | 7/1984 | Binder et al. | 241/294 X |
| 4,807,820 | 2/1989 | Gundlach | 241/294 |

*Primary Examiner*—John Husar

[57] ABSTRACT

A treatment unit for densely compacted sewage sludge having an elongated trough like member with at least one elongated shaft extending throughout its length and rotatably mounted therein. The elongated shaft has a first longitudinal portion with a helix formed thereon. A shear section is located in the trough like member downstream of the first longitudinal portion of the elongated shaft. The shear section includes a static member attached to the inner surface of each sidewall of the trough like member and a rotary component mounted on a second longitudinal portion of the elongated shaft. The rotary component of the shear section includes a pair of half cylinder segments attached to the shaft. Each segment has a first longitudinal section with a plurality of outwardly extending paddles mounted thereon and a second longitudinal section with a plurality of outwardly extending pitched blades mounted thereon. The elongated shaft is rotated by an electric motor mounted on the trough like member.

29 Claims, 5 Drawing Sheets

SLUDGE TREATMENT UNIT

BACKGROUND OF THE INVENTION

1. Field of the Invention

The invention relates generally to a unit for treating very densely compacted sewage sludge cake and mixing the sludge with lime or kiln dust and more particularly to a unit for shredding the very densely compacted sewage sludge cake and mixing the shredded sludge cake with lime or kiln dust.

2. Description of Related Art

It is known to mix solidified dewatered sewage sludge cake produced on a filter press with lime and other additives so that the materials can chemically react to neutralize the toxic chemicals present in the sludge. When sewage sludge and other toxic sludges which are compacted to remove water are mixed with lime or kiln dust at a predetermined rate, an exothermic reaction occurs in which the temperature of the mixture of the sludge and the lime increases with the evolution of steam. Neutralization, agglomeration and other changes occur in the sludge within the mixer unit as the exothermic chemical reaction proceeds. As the lime reacts with the aqueous sludge, dehydration of the sludge occurs with an increase in both temperature and pH value. The increase in the temperature and the pH value of the lime sludge mixture destroys bacteria and viruses which are present in the sludge. Hydrates are formed that tend to bind solid particles in the sludge together to form an agglomeration of particles. The reaction product which is discharged from the mixer unit consists of substantially odor-free, dry, friable particles which may be compacted and used as a landfill material.

SUMMARY OF THE INVENTION

A major object of the present invention is to provide a unit which can separate very densely compacted sewage sludge cake into relatively small particles for subsequent reaction with lime in the unit.

The unit is designed to treat sewage sludge cake which has been subject to compression in a plate and frame filter press. The compression of sewage sludge in such a filter press produces an extremely dense sludge cake which is very fibrous and is, therefore, difficult to separate for subsequent mixing with lime or kiln dust. Because of the consistency and composition of the compressed sludge cake, it is necessary to shred the sludge cake prior to and during mixing. The particles formed from the shredded sludge cake are mixed with lime or kiln dust in a confined elongated trough like member to transform it into a reaction product that is dry and friable.

The treatment unit for the sludge cake is a trough like member having an inlet end wall, an outlet end wall, a bottom wall and sidewalls extending upwardly from the bottom wall. At least one elongated shaft is located in the trough like member and is rotatably mounted in bearings supported in the end walls of the trough like member. The elongated shaft has a first longitudinal portion with a helix formed on the exterior surface. The unit includes a shear section downstream of the first longitudinal portion of the elongated shaft. The shear section has opposed static slotted members attached to the inner surface of each sidewall and a rotary component mounted on the shaft adjacent the first longitudinal portion of the shaft. The rotary component of the shear section includes a pair of half cylinder segments attached to the shaft for rotation therewith. Each half cylinder segment has a first longitudinal section with a plurality of outwardly extending material moving paddles mounted thereon and a second longitudinal section with a plurality of outwardly extending pitched shear blades mounted thereon which assist in moving the material. The shaft is rotated in the bearings by an electric motor or other suitable power means and densely compacted sludge is shredded by the pitched shear blades and the static slotted members in the shear section.

A complete understanding of the invention will be obtained from the following description when taken in connection with the accompanying drawing figures wherein like reference characters identify like parts throughout.

DESCRIPTION OF THE PREFERRED EMBODIMENT

Figure 1:
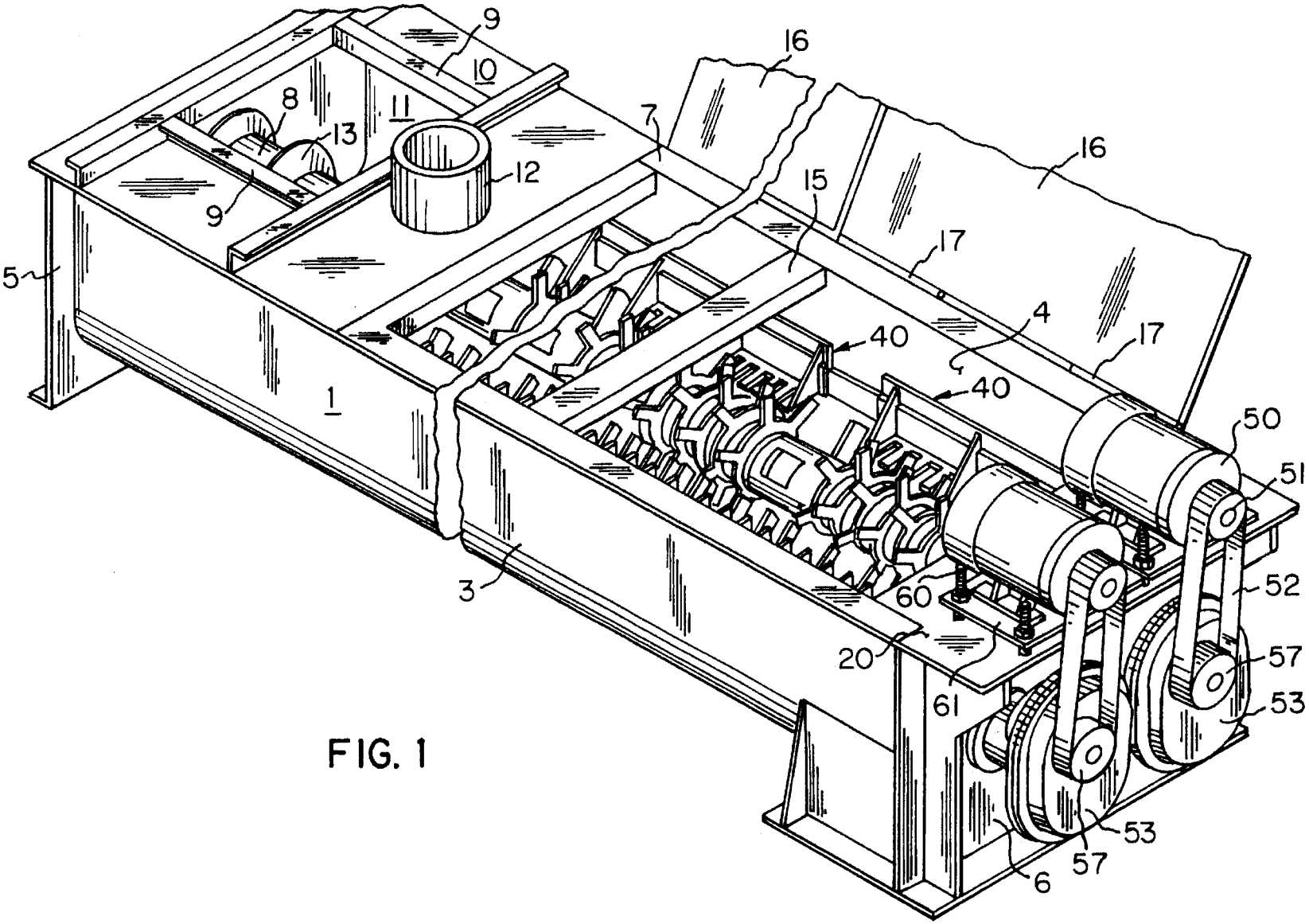
FIG. 1 is a broken perspective view showing a treatment unit according to the invention.

With reference to FIG. 1 of the drawings, the treatment unit consists of a trough like member 1 having a bottom wall, a pair of opposed substantially parallel sidewalls 3 and 4 having their lower longitudinal edges connected to the opposed longitudinal edges of the bottom wall. A rear wall 5 closes the inlet end of trough like member 1 and a front wall 6 closes the outlet end of trough like member 1 which is opposite rear end wall 5. A right-angle, elongated flange 7 is formed along the upper longitudinal edge of each sidewall and a plurality of spaced cross braces 15 extend across the top of trough like member 1 between the flanges on the upper longitudinal edges of sidewalls 3 and 4. The flanges and the cross braces maintain the sidewalls in the desired spaced position and impart rigidity to the trough like member 1. The cross braces also support the lateral edges of cover members 16 when the cover members are in the closed position.

The rear inlet end of trough like member 1 has a fixed top wall section 10 attached to the flanges on the upper longitudinal edges of sidewalls 3 and 4. Top wall section 10 is formed with a material supply opening 11 having parallel right-angle channels 9 at the side edges and a cylindrical conduit 12 for venting gases and/or steam from the interior of trough like member 1 or for feeding material into trough like member 1, as necessary.

Figure 8:
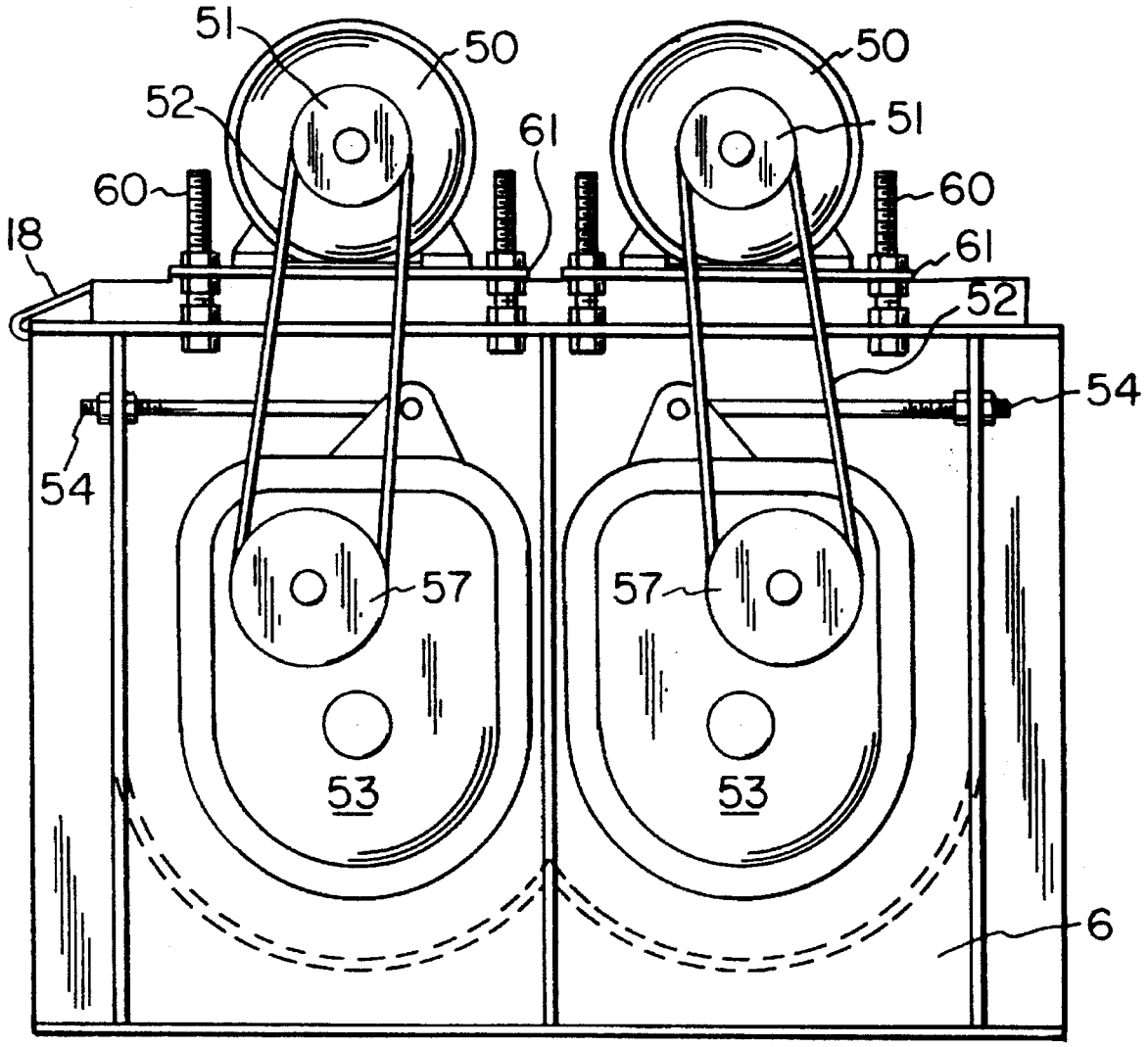
FIG. 8 is an end view of the outlet end of the treatment unit.

A plurality of cover members 16 close the top of trough like member 1, and one edge of each cover member is pivotally connected to channel 7 on sidewall 4 by hinges 17 in a well-known manner. When a cover member 16 is closed, the distal edge of the cover member is firmly attached to the channel on sidewall 3 by a latch 18 as shown in FIG. 8 of the drawings. The cover members are opened as shown in FIG. 1 of the drawings to provide access to the interior of trough like member 1 for cleaning the inside of trough like member 1 and for repairing and/or replacing parts of the treatment unit. A motor support plate 20 extends between flanges 7 at the upper longitudinal edges of sidewalls 3 and 4 at the front outlet end of trough like member 1. Fixed top wall 10; cover members 16 and motor support plate 20 close the top of trough like member 1 when the treatment unit is in operation.

The treatment unit has a pair of substantially parallel elongated shafts 8 which extend substantially throughout the length of trough like member 1; although in certain circumstances, a single shaft can be used. The inlet end of each shaft is connected to a gudgeon shaft 22 which is mounted in a bearing 24 supported in inlet end rear wall 5. A gudgeon shaft 55 is connected to the outlet end of each shaft and is mounted in a bearing 23 in outlet end front wall 6. Each shaft has a first longitudinal portion located adjacent to gudgeon shaft 22 below inlet opening 11 and cylindrical conduit 12. The first longitudinal portion of each shaft 8 has a continuous helix 13 formed thereon to transport material supplied to trough like member 1 through inlet opening 11 and cylindrical conduit 12 along trough like member 1 in the direction of outlet end front wall 6. A first longitudinal shear section 27 of each shaft 8 is located in trough like member 1 adjacent to the inlet portion of each shaft. Each shear section 27 has opposed stationary slotted static members 40 attached to sidewalls 3 and 4 of trough like member 1 and a rotary component attached to each shaft 8. Additional longitudinal shear sections 27 may be located between the first longitudinal shear section and the outlet end of the treatment unit.

Figure 3:
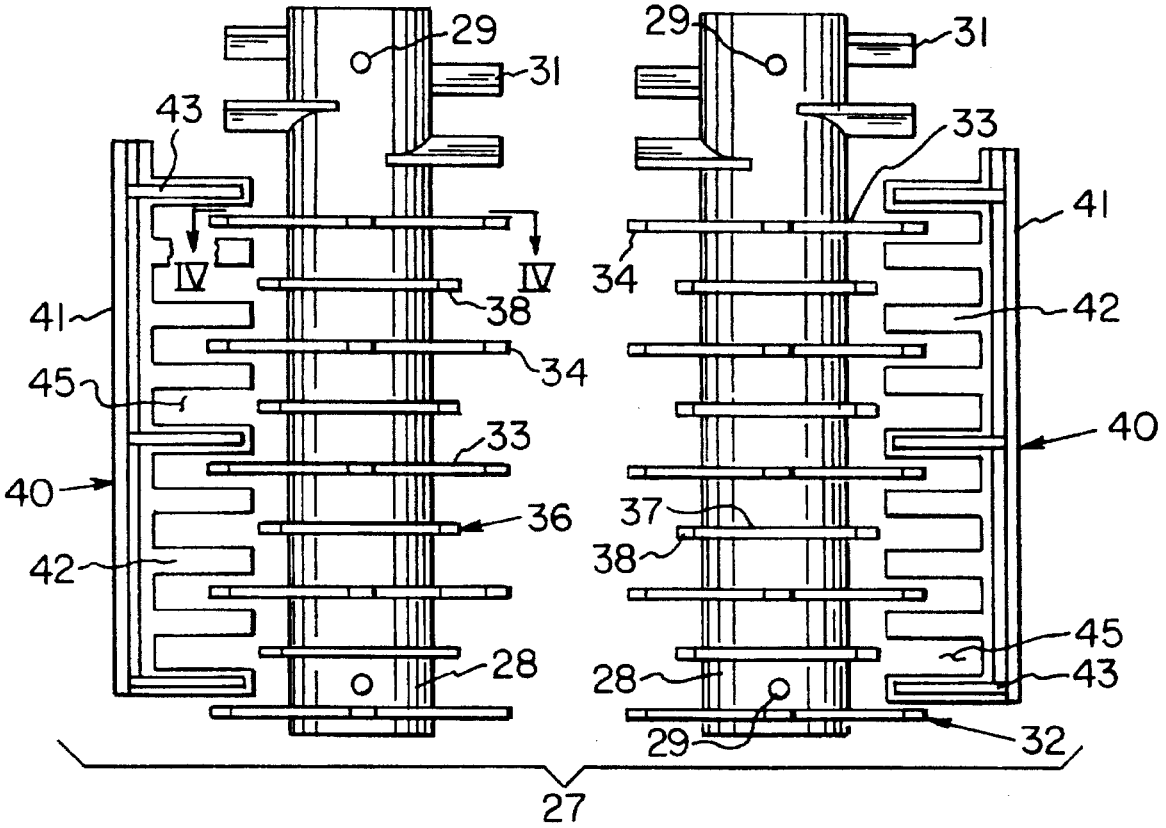
FIG. 3 is a plan view of the shear section shown in FIG. 2.
Figure 4:
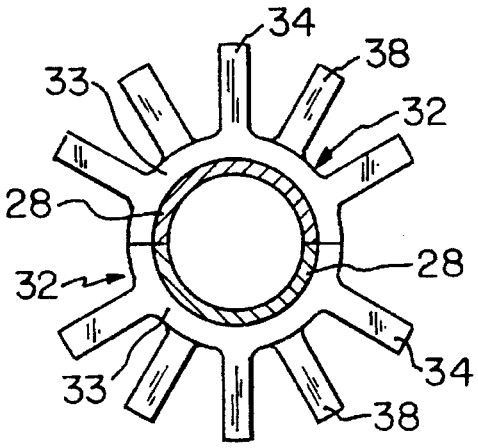
FIG. 4 is a section on line IV—IV of FIG. 3.
Figure 5:
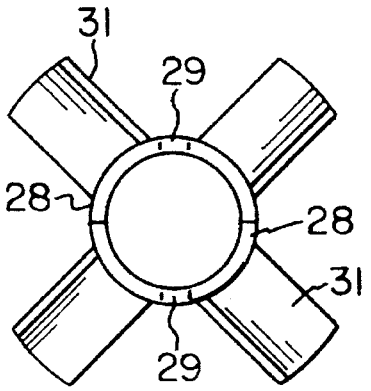
FIG. 5 is an end view of a rotary component of the shear section shown in FIGS. 1–3 showing four paddles.
Figure 6:
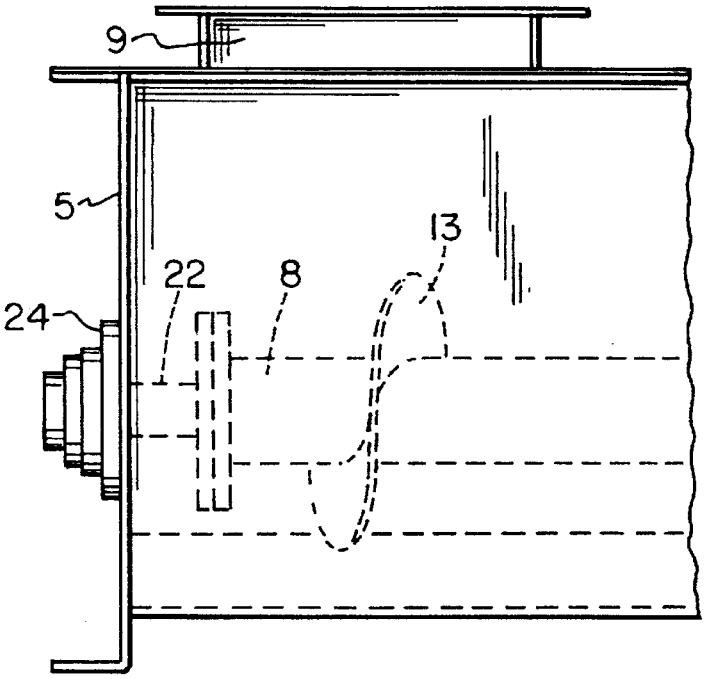
FIG. 6 is a broken elevation of the inlet end of the treatment unit.
Figure 7:
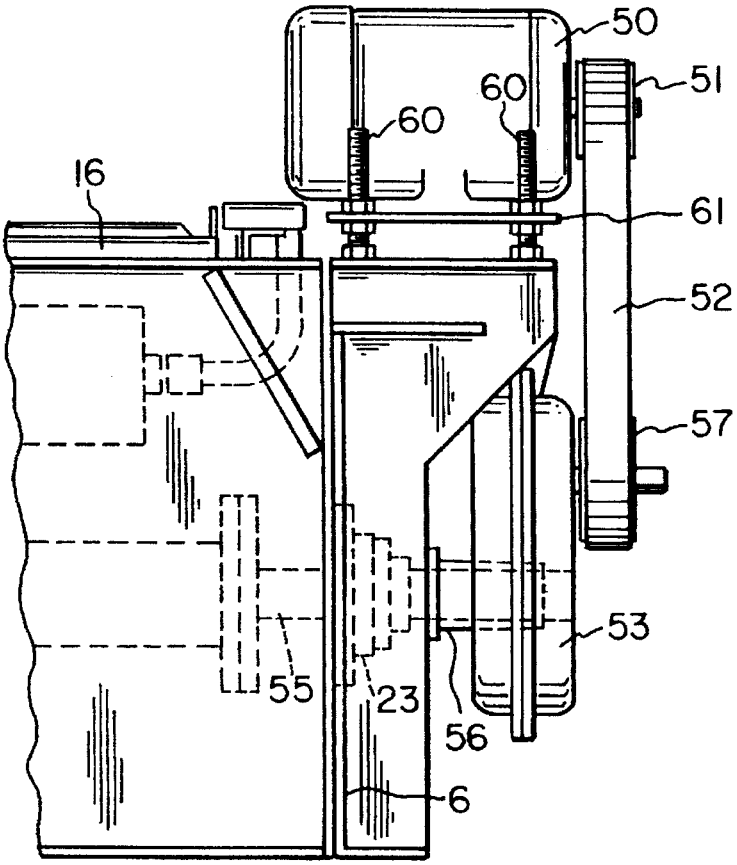
FIG. 7 is a broken elevation of the outlet end of the treatment unit.

The rotary component of each shear section 27 has a pair of half cylinder segments 28 attached to a shaft 8 by radial bolts which extend into the shaft through holes 29 in the ends of the half cylindrical segments. When the two half cylindrical segments are in place on a shaft 8, they form a continuous 360° cylinder surrounding and in contact with the circumference of the shaft. Each half cylindrical segment 28 is formed with a first longitudinal portion 30 on the end closest to inlet end rear wall 5 having two radial paddles 31 located thereon. The paddles are angularly spaced approximately 90° from each other. As shown in FIG. 3 of the drawings, paddles 31 on upper half cylinder segment 28 are longitudinally staggered relative to paddles 31 on lower half cylinder segment 28. The paddles transport material along the length of trough like member 1 in the direction of outlet end front wall 6 as a shaft 8 is rotated in its bearings. Each half cylinder segment also has a plurality of elements 32 with a crescent shaped member 33, and pitched shear blades 34 extending outwardly from the crescent shaped member. Pitched shear blades 34 are angularly spaced 60° around the periphery on the half cylinder segments as shown in FIGS. 3 and 4 of the drawings. Elements 36 alternate with elements 32 along the length of each half cylinder segment 28. Each element 36 has a crescent shaped element 37 attached to a half cylinder segment and pitched shear blades 38 extend outwardly from the crescent shaped portion. Pitched shear blades 38 are angularly spaced 60° around the periphery of the shaft on the half cylinder segments as shown in FIGS. 3 and 4 of the drawings and are angularly located midway between blades 34 on each element 32. Pitched shear blades 34 and 38 assist in transporting material along the trough like member.

Figure 2:
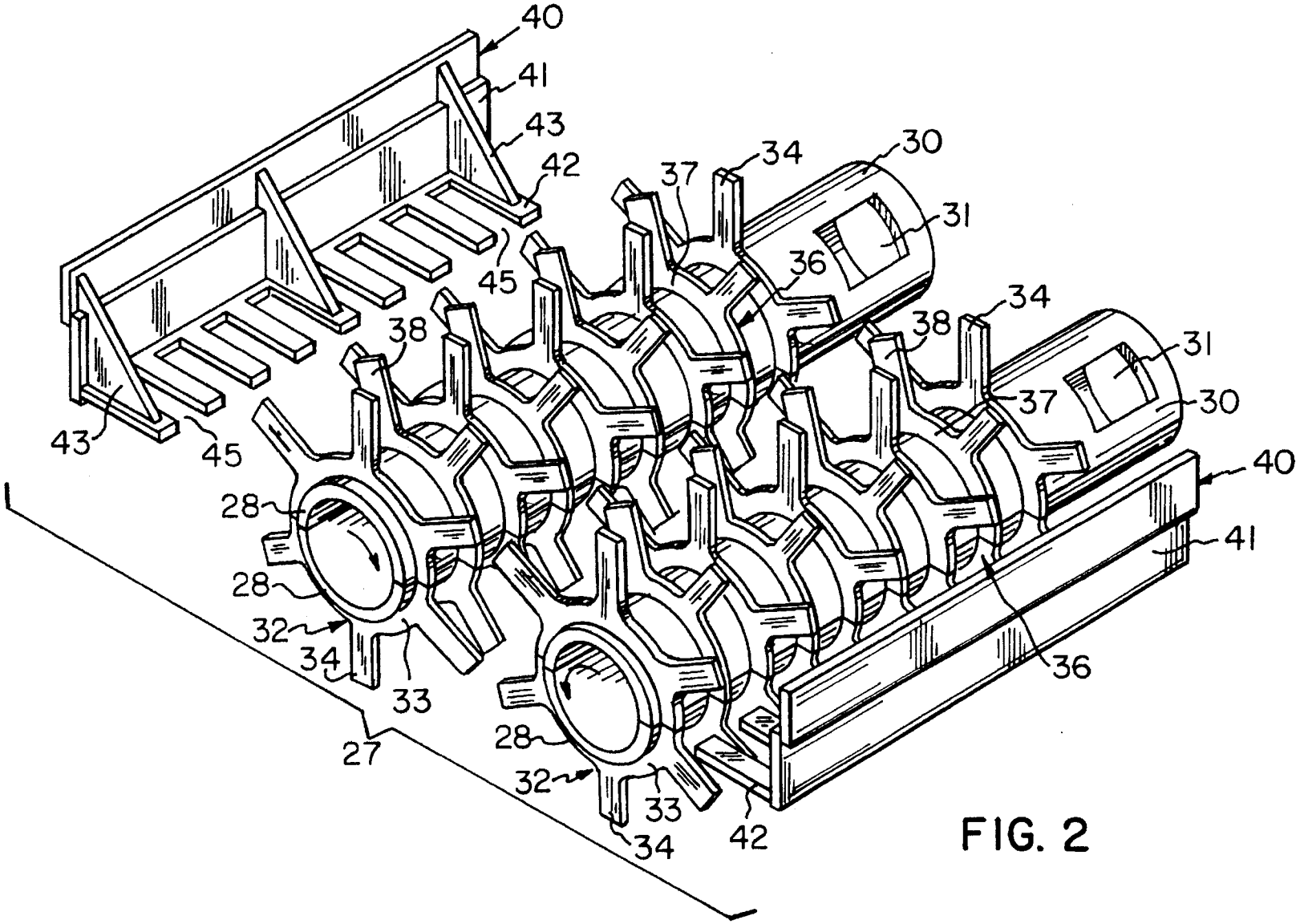
FIG. 2 is a perspective view of a shear section of the treatment unit shown in FIG. 1.

As shown in FIGS. 1-3 of the drawings, each longitudinal shear section 27 of the treatment unit includes opposed slotted static members 40 which are attached to the inner opposed surfaces of sidewalls 3 and 4 of trough like member 1. Each static member 40 has a vertical leg 41 and a horizontal leg 42 located at substantially a right angle to leg 41. The legs are attached along a longitudinal edge and support gussets 43 extend between the inner surfaces of vertical leg 41 and horizontal leg 42. Horizontal leg 42 has a plurality of longitudinally spaced slots 45 which cooperate with pitched shear blades 34 and 38. The pitched shear blades pass close to and through the end of a slot as shafts 8 rotate as shown in FIGS. 1 and 3 of the drawings to shear the densely compacted tough fibrous sludge cake between the edges of the slots and the blades so that pieces of the sludge cake fall into the lower portion of trough like member 1 for chemical reaction and transportation to the outlet end of the trough like member by helices 13, paddles 31 and pitched shear blades 34 and 38.

Each shaft 8 is driven by an electric motor 50 which is mounted on a base plate 61. Each motor has a pulley 51 which drives a V-belt 52 connected to a pulley 57 on the end of a shaft extending from a gear reducer 53. The gear reducer is connected with a bushing 56 for a gudgeon shaft 55 which is supported in a bearing 23 in outlet end front wall 6 of trough like member 1. The vertical position of each electric motor 50 is adjustable by adjustment bolts 60 which raise and lower motor base plates 61 relative to motor support plate 20. A standard adjustable torque arm 54 holds each gear reducer 53 in the desired position relative to its electric drive motor 50.

In operation, heavily compacted tough fibrous material is supplied into trough like member 1 through inlet opening 11 along with lime or kiln dust. The material is initially moved along the trough like member toward outlet end front wall 6 by helices 13 on the inlet portion of each shaft 8 and subsequently by paddles 31 and pitched shear blades 34 and 38 on the segments in each shear section of the treatment unit.

The foregoing describes a preferred embodiment of the invention and is given by way of example only. The invention is not limited to any of the specific features described herein, but includes all such variations thereof within the scope of the appended claims.

We claim:

1. A unit for treating compacted sludge cake, said unit including an elongated trough like member having an inlet end, an outlet end, a bottom wall with spaced opposed longitudinal edges, spaced sidewalls extending upwardly from and attached to said spaced opposed longitudinal edges of said bottom wall, each of said spaced sidewalls having an upper longitudinal edge and an inner surface, an inlet end wall closing said inlet end of said trough like member and an outlet end wall closing said outlet end of said trough like member, at least one elongated shaft located in said trough like member between said inner surfaces of said spaced sidewalls and extending throughout the length of said trough like member between said inlet end and said outlet end, a bearing supported in said inlet end wall and a bearing supported in said outlet end wall, means for supporting a first end of said at least one elongated shaft in said bearing supported in said inlet end wall and means for supporting a second end of said at least one elongated shaft in said bearing supported in said outlet end wall, said at least one elongated shaft having a first longitudinal portion adjacent said first end and a second longitudinal portion adjacent said first longitudinal portion, a helix formed on the exterior surface of said first longitudinal portion of said at least one elongated shaft, at least one shear section located in said trough like member downstream of said first longitudinal portion of said at least one elongated shaft, said at least one shear section having a static member attached to said inner surface of each of said spaced sidewalls and a rotary component mounted on said second longitudinal portion of said at least one elongated shaft adjacent said static members attached to said inner surfaces of said spaced sidewalls, said rotary component of said at least one shear section including a pair of half cylinder segments surrounding the exterior surface of said second longitudinal portion of said at least one elongated shaft and means for attaching each of said half cylinder segments to said second portion of said at least one elongated shaft for rotation therewith, each of said half cylinder segments having a first longitudinal portion and a second longitudinal portion, a plurality of spaced outwardly extending paddles mounted on said first longitudinal portion of each of said half cylinder segments and a plurality of outwardly extending pitched substantially radial blades mounted on said second longitudinal portion of each of said half cylinder segments, and means for rotating said at least one elongated shaft in said bearings, whereby densely compacted sewage sludge is shredded by said pitched substantially radial blades and said static members in said at least one shear section.

2. A treatment unit as set forth in claim 1 wherein each of said static members has a first leg with a longitudinal edge and a second leg extending outwardly from said longitudinal edge of said first leg, said first leg connected to said inner surface of one of said spaced sidewalls and said second leg having a plurality of spaced slots with spaced edges formed therein.

3. A treatment unit as set forth in claim 2 wherein said first leg and said second leg of each of said static members are connected to form an angle of approximately 90° and at least one support gusset extending between said first leg and said second leg of each of said static members.

4. A treatment unit as set forth in claim 2 wherein said slots in said second leg of each of said static members and said pitched substantially radial blades mounted on said second longitudinal portion of each of said half cylinder segments are equally spaced along the length of said mixing unit, whereby said pitched substantially radial blades pass through said slots in said second leg of said static member as said elongated shaft is rotated relative to said static members and said blades and said spaced edges of said spaced slots shred compacted sewage sludge cake.

5. A treatment unit as set forth in claim 1 including a plurality of crescent shaped elements having a first arcuate edge fixed to said second longitudinal portion of each of said half cylinder segments and a second arcuate outer edge, wherein each of said plurality of spaced outwardly extending pitched substantially radial blades is integral with said second arcuate outer edge of a crescent shaped element.

6. A treatment unit as set forth in claim 5 wherein said plurality of spaced outwardly extending pitched substantially radial blades are angularly spaced apart on said second arcuate outer edge of each of said crescent shaped elements by approximately 60°.

7. A treatment unit as set forth in claim 1 wherein each of said half cylinder segments is fixed to said at least one elongated shaft by substantially radially extending bolts.

8. A treatment unit as set forth in claim 1 wherein said portion longitudinal section of each of said half cylinder segments has sets of pitched substantially radial blades longitudinally spaced there along and wherein individual pitched substantially radial blades of alternate sets of said pitched substantially radial blades are angularly staggered relative to individual pitched substantially radial blades of each adjacent set of pitched substantially radial blades.

9. A treatment unit as set forth in claim 8 wherein the individual pitched substantially radial blades in one of said sets of pitched substantially radial blades are angularly staggered relative to the individual blades in each adjacent set of pitched substantially radial blades by approximately 30°.

10. A treatment unit as set forth in claim 1 wherein said means for rotating said at least one elongated shaft is an electric motor mounted on said trough like member, a pulley on said electric motor, a gear reducer mounted on said trough like member operatively connected to said at least one elongated shaft, a pulley on said gear reducer, means for adjusting the position of said electric motor on said trough like member, drive means extending between said pulley on said electric motor and said pulley on said gear reducer for driving said gear reducer to rotate said at least one elongated shaft in said bearings, whereby said drive means is tensioned by adjusting the position of said electric motor on said trough like member.

11. A treatment unit as set forth in claim 1 including at least one cover member having opposed longitudinal edges, hinge means for connecting one of said longitudinal edges of said at least one cover member to said upper longitudinal edge of one of said sidewalls and latch means for connecting the opposite longitudinal edge of said at least one cover member to said upper longitudinal edge of said opposite sidewall, whereby said at least one cover member may be closed during operation of said treatment unit and opened for cleaning and repairing said treatment unit.

12. A treatment unit as set forth in claim 11 including a stationary cover member extending between said upper longitudinal edges of said spaced sidewalls at said inlet end of said trough like member, means forming an inlet opening in said stationary cover member and a cylindrical conduit extending through said stationary cover member adjacent said inlet opening, whereby said inlet opening and said cylindrical conduit provide access between the interior of said trough like member and the atmosphere.

13. A treatment unit as set forth in claim 1 including means forming an outlet opening in said bottom wall of said trough like member adjacent said outlet end, whereby material treated in said unit is discharged from said trough like member through said outlet opening.

14. A treatment unit as set forth in claim 13 including at least one cross brace extending between said flanges to space said sidewalls of said mixing unit.

15. A treatment unit as set forth in claim 1 including an elongated flange extending along said upper longitudinal edge of each of said spaced sidewalls of said trough like member to impart rigidity to said spaced sidewalls of trough like member.

16. A treatment unit as set forth in claim 1 including a second elongated shaft located in said trough like member between said inner surfaces of said spaced sidewalls and extending throughout the length of said trough like member between said inlet end and said outlet end and substantially parallel to said at least one elongated shaft, a second bearing supported in said inlet end wall and a second bearing supported in said outlet end wall, means for supporting a first end of said second elongated shaft in said second bearing supported in said inlet end wall and means for supporting a second end of said second elongated shaft in said second bearing supported in said outlet end wall, said second elongated shaft having a first longitudinal portion adjacent said first end and a second longitudinal portion adjacent said first longitudinal portion, a helix formed on the exterior surface of said first longitudinal portion of said second elongated shaft, a second rotary component of said at least one shear section mounted on said second longitudinal portion of said second elongated shaft adjacent said static members attached to said inner surfaces of said spaced sidewalls, said second rotary component of said at least one shear section including a pair of half cylinder segments surrounding the exterior surface of said second longitudinal portion of said second elongated shaft and means for attaching said pair of half cylinder segments to said second longitudinal portion of said elongated shaft for rotation therewith, each of said half cylinder segments having a first longitudinal portion and a second longitudinal portion, a plurality of outwardly extending paddles mounted on said first longitudinal portion of each of said half cylinder segments and a plurality of outwardly extending pitched substantially radial blades mounted on said second longitudinal section of each of said half cylinder segments, and means for rotating said second elongated shaft in said second bearings, whereby densely compacted sewage sludge is shredded by said pitched substantially radial blades on said second elongated shaft and one of said static members of said at least one shear section.

17. A treatment unit for treating compacted sludge cake, said unit including an elongated trough like member having an inlet end, an outlet end, a bottom wall with spaced opposed longitudinal edges, spaced sidewalls extending upwardly from and attached to said spaced opposed longitudinal edges of said bottom wall, each of said spaced sidewalls having an upper longitudinal edge and an inner surface, an inlet end wall closing said inlet end of said trough like member and an outlet end wall closing said outlet end of said trough like member, at least one elongated shaft located in said trough like member between said inner surfaces of said spaced sidewalls and extending throughout the length of said trough like member between said inlet end and said outlet end, a bearing supported in said inlet end wall and a bearing supported in said outlet end wall, means for supporting a first end of said at least one elongated shaft in said bearing supported in said inlet end wall and means for supporting a second end of said at least one elongated shaft in said bearing supported in said outlet end wall, said at least one elongated shaft having a first longitudinal portion adjacent said first end and a second longitudinal portion adjacent said first longitudinal portion, a helix formed on the exterior surface of said first longitudinal portion of said at least one elongated shaft, at least one shear section located in said trough like member downstream of said first longitudinal portion of said at least one elongated shaft, said at least one shear section having a static member attached to said inner surface of each of said sidewalls and a rotary component mounted on said second longitudinal portion of said at least one elongated shaft adjacent said static members attached to said inner surfaces of said spaced sidewalls, said rotary component of said at least one shear section including a pair of half cylinder segments surrounding the exterior surface of said second longitudinal portion of said at least one elongated shaft and means for attaching said pair of half cylinder segments to said at least one elongated shaft for rotation therewith, each of said half cylinder segments having a longitudinal portion and a plurality of spaced outwardly extending pitched blades mounted on said longitudinal portion, and means for rotating said at least one elongated shaft in said bearings, whereby densely compacted sludge is shredded by said outwardly extending pitched blades and said static members of said at least one shear section.

18. A treatment unit as set forth in claim 17 wherein each of said static members has a first leg with a longitudinal edge and a second leg extending outwardly at substantially a right-angle from said longitudinal edge of said first leg, said first leg connected to said inner surface of one of said sidewalls and said second leg having a plurality of spaced slots with spaced edges formed therein.

19. A treatment unit as set forth in claim 18 wherein said slots in said second leg of each of said static members and said outwardly extending pitched blades mounted on said longitudinal portion of each of said half cylinder segments are equally spaced along the length of said longitudinal portion, whereby said blades pass through said slots as said at least one elongated shaft is rotated relative to said static members and said blades and the edges of said slots shred compacted sewage sludge cake.

20. A treatment unit for treating compacted sludge cake, said unit including an elongated trough like member having an inlet end, an outlet end, a bottom wall with spaced opposed longitudinal edges, spaced sidewalls extending upwardly from and attached to said spaced opposed longitudinal edges of said bottom wall, each of said spaced sidewalls having an upper longitudinal edge and an inner surface, an inlet end wall closing said inlet end of said trough like member and an outlet end wall closing said outlet end of said trough like member, a pair of substantially parallel elongated shafts located in said trough like member between said inner surfaces of said spaced sidewalls and extending throughout the length of said trough like member between said inlet end and said outlet end, bearings supported in said inlet end wall and bearings supported in said outlet end wall, means for supporting a first end of each of said elongated shafts in one of said bearings supported in said inlet end wall and means for supporting a second end of each of said elongated shafts in one of said bearings supported in said outlet end wall, a shear section located in said trough like member downstream of said first end of each of said elongated shafts, said shear section having a static member attached to said inner surface of each of said spaced sidewalls and a rotary component mounted on a longitudinal portion of each of said elongated shafts, each of said rotary components of said shear section including a pair of half cylinder segments surrounding the exterior surface of said longitudinal portion of each of said elongated shafts and means for attaching each pair of half cylinder segments to said longitudinal portion of one of said elongated shafts for rotation therewith, a plurality of spaced outwardly extending pitched blades mounted on each of said half cylinder segments, and means for rotating said elongated shafts in said bearings, whereby densely compacted sludge is shredded by said outwardly extending pitched blades and said static members of said shear section.

21. A unit for treating compacted sludge cake, said unit including an elongated trough like member having an inlet end, an outlet end, a bottom wall with spaced opposed longitudinal edges, spaced sidewalls extending upwardly from said spaced opposed longitudinal edges of said bottom wall, each of said sidewalls having an upper longitudinal edge and an inner surface, an inlet end wall closing said inlet end of said trough like member and an outlet end wall closing said outlet end of said trough like member, at least one elongated shaft located in said trough like member between said inner surfaces of said spaced sidewalls and extending throughout the length of said trough like member between said inlet end and said outlet end, a bearing supported in said inlet end wall and a bearing supported in said outlet end wall, means for supporting a first end of said at least one elongated shaft in said bearing supported in said inlet end wall and means for supporting a second end of said at least one elongated shaft in said bearing supported in said outlet end wall, said at least one elongated shaft having a longitudinal portion, at least one shear section located in said trough like member, said at least one shear section including a static member attached to said inner surface of each of said sidewalls and a rotary component mounted on said longitudinal portion of said at least one elongated shaft adjacent said static members attached to said inner surfaces of said spaced sidewalls, said rotary component of said at least one shear section including a pair of curved segments surrounding the exterior surface of said longitudinal portion of said at least one elongated shaft, means for attaching said pair of curved segments to said at least one elongated shaft for rotation therewith, each of said curved segments having a longitudinal portion and a plurality of spaced outwardly extending blades mounted on said longitudinal portion, and means for rotating said at least one elongated shaft in said bearings, whereby densely compacted sludge is shredded in said at least one shear section.

22. A treatment unit as set forth in claim 21 wherein each of said static members has a first leg with a longitudinal edge and a second leg extending outwardly at substantially a right-angle from said longitudinal edge of said first leg, said first leg connected to said inner surface of one of said sidewalls and said second leg having a plurality of spaced slots formed therein.

23. A treatment unit as set forth in claim 22 wherein said spaced slots in said second leg of each of said static members and said outwardly extending blades mounted on said longitudinal portion of each of said curved segments are equally spaced along the length of said longitudinal portion, whereby said blades pass through said slots as said at least one elongated shaft is rotated relative to said static members and said blades and the edges of said slots shred compacted sewage sludge cake.

24. A rotary component for use in a shear section of a shredding apparatus, said rotary component includes a curved elongated segment adapted to be mounted on the exterior surface of a shaft, said curved elongated segment having a longitudinal portion, and a plurality of angularly and longitudinally spaced outwardly extending substantially radial blades mounted on said longitudinal portion of said curved elongated segment.

25. A rotary component as set forth in claim 25 including a plurality of spaced crescent shaped elements having a first arcuate edge fixed to said longitudinal portion of said curved elongated segment and a second arcuate outer edge radially spaced from said first arcuate edge, wherein each of said plurality of spaced outwardly extending substantially radial blades is integral with a crescent shaped element and extends outwardly from said second arcuate outer edge of said crescent shaped element.

26. A rotary component as set forth in claim 25 wherein said plurality of spaced outwardly extending substantially radial blades are angularly spaced apart on said second arcuate outer edge of said crescent shaped element by approximately 60°.

27. A rotary component as set forth in claim 24 wherein said longitudinal portion of said segment has sets of longitudinally spaced outwardly extending substantially radial blades and wherein individual substantially radial blades of alternate sets of said spaced outwardly extending substantially radial blades are angularly staggered relative to individual spaced outwardly extending substantially radial blades of each adjacent set of spaced outwardly extending substantially radial blades.

28. A rotary component as set forth in claim 27 wherein the individual outwardly extending substantially radial blades in one of said sets of outwardly extending substantially radial blades are angularly staggered relative to the individual blades in each adjacent set of outwardly extending substantially radial blades by approximately 30°.

29. A component for use in a shear section of a sludge cake treating apparatus, said component including a semicircular elongated segment having a curved inner surface adapted to overlie a portion of the exterior surface of a rotary shaft, said elongated segment having a curved outer surface with a first longitudinal portion and a second longitudinal portion coextensive with said first longitudinal portion, a plurality of outwardly extending paddles mounted on said curved outer surface of said first longitudinal portion of said segment and a plurality of longitudinally spaced outwardly extending substantially radial blades mounted on said curved outer surface of said second longitudinal portion of said segment.

* * * * *

UNITED STATES PATENT AND TRADEMARK OFFICE

CERTIFICATE OF CORRECTION

PATENT NO. : 5,639,035

DATED : June 17, 1997

INVENTOR(S) : Thad S. Maugle and David A. Rhoa

It is certified that error appears in the above-indentified patent and that said Letters Patent is hereby corrected as shown below:

On the title page, under Primary Examiner insert: Attorney, Agent or Firm, to read --Webb Ziesenheim Bruening Logsdon Orkin & Hanson, P.C.

Claim 8 Column 5 Line 63 "portion longitudinal section" should read --second longitudinal portion--.

Claim 16 Column 7 Line 19 "section" should read --portion--.

Claim 25 Column 10 Line 1 "set forth in claim 25" should read --set forth in claim 24--.

Signed and Sealed this

Fourth Day of November, 1997

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,639,035

DATED : June 17, 1997

INVENTOR(S) : Thad S. Maugle and David A. Rhoa

It is certified that error appears in the above-indentified patent and that said Letters Patent is hereby corrected as shown below:

Title Page, insert: [73] Assignee: McLanahan Corporation, Hollidaysburg, Pa.

Claim 8 Column 5 Line 63 "portion longitudinal section" should read --second longitudinal portion--.

Claim 16 Column 7 Line 19 "section" should read --portion--.

Claim 25 Column 10 Line 1 "set forth in claim 25" should read --set forth in claim 24--.

On the tittle page, under Primary Examiner, insert: Attorney, Agent Firm, to read --Webb Ziesenheim Bruening Logsdon Orkin & Hanson, P.C.--

This certificate supersedes Certificate of Correction issued November 4, 1997

Signed and Sealed this

Sixteenth Day of December, 1997

*Attest:*

*Attesting Officer*

BRUCE LEHMAN

*Commissioner of Patents and Trademarks*